252-146 AU 160 CX
12/14/82 XP 4,363,741

United States Patent [19]

Gould

[11] 4,363,741

[45] Dec. 14, 1982

[54] AUTOMOTIVE COOLING SYSTEM CLEANER

[75] Inventor: Joseph C. Gould, Norwood, Pa.

[73] Assignee: Borden, Inc., Columbus, Ohio

[21] Appl. No.: 293,011

[22] Filed: Aug. 14, 1981

Related U.S. Application Data

[63] Continuation-in-part of Ser. No. 218,416, Dec. 19, 1980.

[51] Int. Cl.[3] ..... C11D 7/08; C11D 7/14; C11D 7/24; C23G 1/02

[52] U.S. Cl. ..... 252/142; 252/146; 252/156; 252/546; 252/548; 252/174.15; 252/174.19; 252/174.21; 252/174.25; 134/3

[58] Field of Search ..... 252/173, 142, 146, 156, 252/548, 546, 174.15, 174.21, 174.22, 174.19, 174.25, DIG. 14; 134/3

[56] References Cited

U.S. PATENT DOCUMENTS

| | | | |
|---|---|---|---|
| 3,162,547 | 12/1964 | Kendall | 252/142 |
| 3,242,093 | 3/1966 | Compton | 252/142 |
| 3,248,269 | 4/1966 | Bell | 148/6.14 |
| 3,779,934 | 12/1973 | Altenschopfer et al. | 252/142 |
| 3,957,529 | 5/1976 | Alexander et al. | 134/3 |
| 3,959,166 | 5/1976 | Oberhofer et al. | 252/146 |
| 3,962,109 | 6/1976 | Oberhofer et al. | 252/146 |
| 3,997,460 | 12/1976 | Sirine | 252/142 |
| 4,097,306 | 6/1978 | Carman | 134/10 |
| 4,152,305 | 5/1979 | Berghausen | 252/156 |

FOREIGN PATENT DOCUMENTS 626116 12/1976 U.S.S.R. .

OTHER PUBLICATIONS

Emulsifiers & Detergents, North American 1981, pp. 275, 276.

*Primary Examiner*—John E. Kittle
*Assistant Examiner*—Hoa Van Le
*Attorney, Agent, or Firm*—George P. Maskas; Kenneth P. Van Wyck

[57] ABSTRACT

A novel composition for removing grease, grime and corrosion from automotive cooling systems consists essentially of water, citric acid, ammonium hydroxide, a defoamer comprised of a blend of mineral oils and silica derivatives, and an octylphenoxypolyethoxyethanol non-ionic surfactant having 30 moles of ethylene oxide per mole of t-octylphenol.

4 Claims, No Drawings

AUTOMOTIVE COOLING SYSTEM CLEANER

CROSS REFERENCE TO RELATED APPLICATION

This application is a continuation-in-part of application Ser. No. 218,416 filed Dec. 19, 1980.

BACKGROUND OF THE INVENTION

Combustion temperatures in automobile engines can exceed 5000° F. About one-third of this heat energy generated by an engine is dissipated by a properly functioning cooling system. If this excess heat is not continuously removed, the engine could sustain costly damage or even burn out.

Because the cooling system does a critical job in keeping the engine at an efficient operating temperature, it is important to properly maintain the system. In its normal job of cooling the engine, however, the cooling system is exposed to corrosion and the accumulation of rust, scale, grease and oil, all of which inhibit the system from operating at peak efficiency. Consequently, a suitable maintenance program should provide for the regular removal of any built-up grease, grime or rust in the system. The present invention relates to a novel composition for removing corrosion, grease and grime in an automotive cooling system.

Compositions that remove corrosion, grease and grime from metal surfaces in general are known. A representative composition is described in U.S. Pat. No. 3,242,093, issued Mar. 22, 1966 to Compton. As pointed out by Compton, most corroded metals that are to be cleaned usually have layers of rust, scale and/or soil composed of oil, grease and dirt on their surfaces. Most known rust removing cleaners, however, cannot be used without precleaning the metal surface to remove the bulk of the undesirable materials prior to removing the rust or corrosion. Furthermore, these precleaning techniques are often complicated, time consuming and quite often require the use of highly toxic chemicals which would not be suitable for domestic or household use.

Consequently, there exists a need for a one-step cleaner capable of simultaneously removing rust, grease and grime, which is also efficient, effective and non-toxic. The present invention meets those needs as they relate to the formulation for an automotive cooling system cleaner.

SUMMARY OF THE INVENTION

This novel composition for cleaning automotive cooling systems consists essentially of, by weight, from about:

(1) 30.50–97.55%, preferably 52.02–68.18%, deionized water;

(2) 1–30%, preferably 16–24%, citric acid;

(3) 0.9–27%, preferably 14.5–22%, ammonium hydroxide;

(4) 0.5–10%, preferably 1.2–1.8% of an octylphenoxypolyethoxyethanol, non-ionic surfactant having the formula

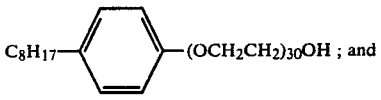

$C_8H_{17}$—(C6H4)—$(OCH_2CH_2)_{30}OH$ ; and (5) 0.05–2.50%, preferably 1.2–1.8%, of a non-ionic defoamer comprised of a blend of mineral oils and silica derivatives, having a specific gravity of 0.91–0.93 and a viscosity of 1,000–1,800 centipoise (measured at 25° C. using a #3 spindle at 20 rpm);

the entire composition being adjusted to a pH approximately between 8.5 and 4.5, preferably 5.5 and 6.5.

The invention has been found to be effective in removing grease, grime and surface corrosion from cooling systems formed in whole or in part from one or more of the group of metals consisting of copper, brass, lead solder, cast iron, steel and aluminum.

DETAILED DESCRIPTION OF THE INVENTION

The most preferred formulation of the invention is a composition consisting essentially of, by weight: 59.81% deionized water, 20.12% citric acid, 18.28% ammonium hydroxide, 1.64% of an octylphenoxypolyethoxyethanol, non-ionic surfactant having the formula

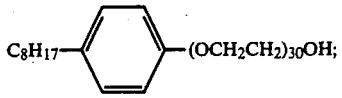

$C_8H_{17}$—(C6H4)—$(OCH_2CH_2)_{30}OH$;

and 0.15% of a defoamer comprised of a blend of mineral oils and silica derivatives, having a specific gravity of 0.91–0.93 and a viscosity of 1,000–1,800 centipoise (measured at 25° C. using a #3 spindle at 20 rpm); the entire composition being adjusted to a pH of 6.2.

Directions for use of the invention call for pouring it into a previously flushed cooling system and idling the engine for 30 minutes. The cooling system is then flushed with water and recharged with an appropriate amount of antifreeze and water. For the conditions under which the invention will be used, it has been discovered that the only suitable non-ionic surfactant is an octylphenoxypolyethoxyethanol, non-ionic surfactant, having the formula

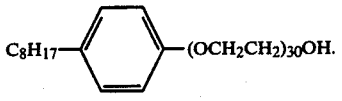

$C_8H_{17}$—(C6H4)—$(OCH_2CH_2)_{30}OH$.

This product is prepared by reacting 30 moles of ethylene oxide per mole of t-octylphenol. Such a product, suitable for use in the present invention, is marketed by Rohm and Haas as Triton X-305.

Laboratory tests demonstrate that the invention is superior to present cooling system cleaners in the field in its ability to safely clean cooling systems of rust and grease. The test involved immersing in various cooling system cleaners, pre-rusted auto body steel panels and grease coated bronze screens. The amounts of cleaner used, the length of time in the cleaning solution and the temperature of the solution were set according to the product's label directions. Results were as follows:

| Product Name | Essential Composition | Manufacturer | Results: % Rust Removed | Results: % Grease Removed |
|---|---|---|---|---|
| One-Step Flush | Ammonium citrate and octyl- | Du Pont | 80 | 99 |

-continued

| Product Name | Essential Composition | Manufacturer | Results % Rust Removed | Results % Grease Removed |
|---|---|---|---|---|
| (present invention) | phenoxypolyethoxyethanol surfactant in proportions as described above in the most preferred formulation of the invention | | | |
| Super Flush | Aqueous non-ionic detergent (trace of ammonium citrate possible) | Union Carbide | 0 | 99 |
| Peak Cleaner | ammonium citrate, anionic detergent | Northern Petrochemical Co. | 95 | 50 |

Of the competitive flush produces suitable for consumer use, it is clear that the present invention is superior. Furthermore, the excellent cleaning properties are obtained without significant risk to the consumer. The invention was tested and classified according to the regulations of the Federal Hazardous Substances Act, the results of which show that the invention is neither an eye or skin irritant nor toxic orally.

The preparation of the invention is straightforward, being a simple "add and stir" formulation involving no unusual process or equipment. The process of preparation is illustrated by the following example.

EXAMPLE

| Ingredient | 100 Gallon Formula Pounds Required | Comments |
|---|---|---|
| Tap Water | 430.50 | |
| Citric Acid-Anhydrous | 237.30 | Add and mix 15 minutes. |
| Ammonium Hydroxide | 215.20 | Add slowly over 30 minutes with mixing. Batch will have a slight exotherm. Keep cooling water on jacket. Do not allow batch temperature to exceed 100° F. |
| Triton X-305 (Octylphenoxypolyethoxyethanol non-ionic surfactant of the formula 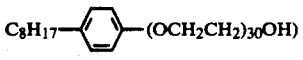 | 20.00 | Hold out of batch during manufacturing. This is to be injected into container during fill-out. Inject 7.8 cc ± 0.1 cc per 12 fl. oz. container. |
| Defoamer L-475 (Drew Chemical Co.) Blend of mineral oils and silica derivatives having a specific gravity of 0.91–0.93 and a viscosity of 1,000–1,800 centipoise (measured at 25° C. using a #3 spindle at 20 rpm | 2.00 | Add to batch with mixing. Mix batch 30 minutes with cooling. Cool to 75° F. Check pH of batch. If pH is below 6.1 add ammonium hydroxide to adjust pH to 6.2. If pH is above 6.3, add anhydrous citric acid to adjust to 6.2. The pH must be done with sample mixing. |
| Total | 905.00 | Fill out into 12 fl. oz. plastic containers - 12 fl. oz.'s per container. |

Caution:
Only stainless steel equipment should be used to manufacture and fill this product. Product will react with black iron.

What is claimed is:

1. An automotive cooling system cleaner consisting essentially of, by weight, from about:
   (a) 30.50–97.55% deionized water;
   (b) 1–30% citric acid;
   (c) 0.9–27% ammonium hydroxide;
   (d) 0.5–10% of an octylphenoxypolyethoxyethanol, non-ionic surfactant having the formula

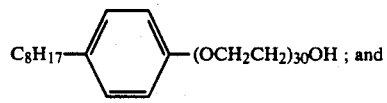

(e) 0.05–2.50% of a defoamer comprised of a blend of mineral oils and silica derivatives, having a specific gravity of 0.91–0.93 and a viscosity of 1,000–1,800 centipoise (measured at 25° C. using a #3 spindle at 20 rpm);

the entire composition being adjusted to a pH approximately between 8.5 and 4.5.

2. The composition of claim 1 wherein (a) is from 52.02–68.18%, (b) is from 16–24%, (c) is from 14.5–22%, (d) is from 1.2–1.8%, (e) is from 0.12–0.17%, and the entire composition is adjusted to a pH approximately between 5.5 and 6.5.

3. The composition of claim 1 wherein (a) is 59.81%, (b) is 20.12%, (c) is 18.28%, (d) is 1.64%, (e) is 0.15%, and the entire composition is adjusted to a pH of 6.2.

4. The cleaner of claim 1, 2, or 3 where it is used to remove grease, grime and surface oxidation from a cooling system formed in whole or in part from one or more of the group of metals consisting of copper, brass, lead solder, cast iron, steel and aluminum.

* * * * *